US009945155B2

(12) United States Patent
Kushida et al.

(10) Patent No.: US 9,945,155 B2
(45) Date of Patent: Apr. 17, 2018

(54) CYLINDER LOCK DEVICE

(71) Applicants: KABUSHIKI KAISHA TOKAI RIKA DENKI SEISAKUSHO, Aichi (JP); TOYOTA JIDOSHA KABUSHIKI KAISHA, Toyota-shi, Aichi-ken (JP)

(72) Inventors: Tomohide Kushida, Aichi (JP); Yoshiki Ishikawa, Toyota (JP)

(73) Assignees: KABUSHIKI KAISHA TOKAI RIKA DENKI SEISAKUSHO, Aichi (JP); TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 14/724,075

(22) Filed: May 28, 2015

(65) Prior Publication Data

US 2015/0345179 A1 Dec. 3, 2015

(30) Foreign Application Priority Data

Jun. 2, 2014 (JP) ..... 2014-114070

(51) Int. Cl.
*E05B 17/04* (2006.01)
*E05B 27/00* (2006.01)
(Continued)

(52) U.S. Cl.
CPC ..... *E05B 27/0007* (2013.01); *E05B 79/22* (2013.01); *E05B 85/06* (2013.01);
(Continued)

(58) Field of Classification Search
CPC ..... E05B 27/007; E05B 79/22; E05B 85/06; E05B 79/20; E05B 79/12; E05B 79/10;
(Continued)

(56) References Cited

U.S. PATENT DOCUMENTS 4,815,306 A * 3/1989 Feichtiger ..... E05B 77/50 70/240
5,685,405 A * 11/1997 Morikawa ..... F16H 61/22 192/220.2
(Continued)

FOREIGN PATENT DOCUMENTS

CN 202559895 U 11/2012
JP 2000-034851 2/2000
(Continued)

OTHER PUBLICATIONS

Japanese Office Action in related Japanese Application No. 2014-114070 dated Jun. 7, 2016, and English translation thereof.
(Continued)

*Primary Examiner* — Suzanne Barrett
*Assistant Examiner* — Morgan McClure
(74) *Attorney, Agent, or Firm* — Roberts Mlokowski Safran Cole & Calderon, P.C.

(57) ABSTRACT

A cylinder lock device includes a body, a rotor rotatably arranged inside the body, a holder lever rotationally driven according to a rotation of the rotor, an engagement lever that is link-connected to the holder lever so as to be angularly adjustable and rotationally driven according to a rotation of the rotor, and a retention mechanism to hold the engagement lever into a predetermined direction relative to the body. The retention mechanism is configured to force a protrusion on the engagement lever to contact the holder lever by an elastic force thereof.

5 Claims, 3 Drawing Sheets

(51) Int. Cl.
*E05B 79/22* (2014.01)
*E05B 85/06* (2014.01)
*E05B 79/20* (2014.01)
*E05B 79/12* (2014.01)

(52) U.S. Cl.
CPC ..... *E05B 27/0046* (2013.01); *E05B 79/12* (2013.01); *E05B 79/20* (2013.01); *Y10T 70/7486* (2015.04)

(58) Field of Classification Search
CPC ..... E05B 79/02; E05B 79/08; E05B 79/16; E05B 27/0007; E05B 27/0046; Y10T 70/7486
USPC ..... 70/379 R, 380, 237, 245, 256, 266, 490; 292/195, 200, 145, 141, 196, 221, 223, 292/225, 226, 228
See application file for complete search history.

(56) References Cited

U.S. PATENT DOCUMENTS 6,851,538 B2 * 2/2005 Meyer ..... F16H 59/10 192/219.4
8,720,240 B2 * 5/2014 Flandrinck ..... E05B 17/041 70/237
8,978,428 B2 * 3/2015 Trent ..... E05B 47/0012 292/336.3
2002/0073754 A1 * 6/2002 Katagiri ..... E05B 17/041 70/379 R
2006/0130540 A1 * 6/2006 Lin ..... E05B 37/14 70/21
2007/0234768 A1 * 10/2007 Yamaguchi ..... E05B 17/04 70/379 R
2011/0277519 A1 * 11/2011 Hirashita ..... B60R 25/02153 70/237

FOREIGN PATENT DOCUMENTS

JP 2002188331 A1 7/2002
JP 2007277987 A 10/2007

OTHER PUBLICATIONS

Office Action issued in the corresponding Chinese Application No. 201510292792.9 dated Jun. 2, 2017.

* cited by examiner

CYLINDER LOCK DEVICE

The present application is based on Japanese patent application No. 2014-114070 filed on Jun. 2, 2014, the entire contents of which are incorporated herein by reference.

BACKGROUND OF THE INVENTION

1. Field of the Invention

The invention relates to a cylinder lock device for locking or unlocking door handle operation.

2. Description of the Related Art

In general, cylinder lock devices for vehicle door are installed around a handle. In a cylinder lock device, a rotor is provided to rotationally move in accordance with insertion and operation of a key and an engaging member is pivotally coupled to and rotates together with the rotor. The engaging member is connected to a lock mechanism arranged in a door panel and the lock mechanism is shifted to the locked or unlocked state by a turning force of the rotor (JP-A-2000-34851).

In this cylinder lock device, a long hole is formed on an engagement lever so that the engagement lever is pivotally coupled to the rotor through the long hole. Meanwhile, a recessed portion is formed on a bottom of a groove on the rotor so that the engagement lever, when pivoting upward about a pin, enters the recessed portion under its own weight and moves forward to a position at which the pin is engaged with an edge of the long hole. In this configuration, the innermost wall of the groove of the rotor is located on a pivoting trajectory of a proximal end of the engagement lever and the proximal end of the engagement lever is stopped by the wall, thereby restricting downward pivot of the engagement lever under its own weight. Therefore, it is possible to hold the engagement lever at a temporary position without supporting by a hand and mounting work efficiency is thus improved.

SUMMARY OF THE INVENTION

In such a configuration, although it is possible to hold the engagement lever at a temporary position without supporting by a hand, it is difficult to return the engagement lever back to the temporary position if, for example, an angle of the engagement lever with respect to the rotor is greatly changed during transportation, etc. Thus, the angle of the engagement lever needs to be checked before mounting work and, if necessary, to be corrected.

It is an object of the invention to provide a cylinder lock device that allows the engagement lever to be held into a predetermined direction during the mounting process so as to improve the mounting workability thereof.

(1) According to one embodiment of the invention, a cylinder lock device comprises:

a body;

a rotor rotatably arranged inside the body;

a holder lever rotationally driven according to a rotation of the rotor;

an engagement lever that is link-connected to the holder lever so as to be angularly adjustable and rotationally driven according to a rotation of the rotor; and a retention mechanism to hold the engagement lever into a predetermined direction relative to the body, wherein the retention mechanism is configured to force a protrusion on the engagement lever to contact the holder lever by an elastic force thereof.

In the above embodiment (1) of the invention, the following modifications and changes can be made.

(i) The retention mechanism comprises a resilient member to generate the elastic force.

(ii) The engagement lever comprises a pressing surface pressed by the resilient member, and wherein the pressing surface is inclined relative to the predetermined direction.

(iii) The resilient member comprises a rubber material.

(2) According to another embodiment of the invention, a cylinder lock device comprises:

a body;

a rotor rotatably arranged inside the body;

a holder lever rotationally driven according to a rotation of the rotor;

an engagement lever that is link-connected to the holder lever so as to be angularly adjustable and rotationally driven according to a rotation of the rotor; and a resilient member disposed between the holder lever and the engagement lever so as to hold the engagement lever into a predetermined direction relative to the body.

In the above embodiment (2) of the invention, the following modifications and changes can be made.

(iv) The engagement lever comprises a pressing surface pressed by the resilient member, and wherein the pressing surface is inclined relative to the predetermined direction.

(v) The resilient member comprises a rubber material.

Effects of the Invention

According to one embodiment of the invention, a cylinder lock device can be provided that allows the engagement lever to be held into a predetermined direction during the mounting process so as to improve the mounting workability thereof.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

An embodiment of the invention will be specifically described below in conjunction with the appended drawings.

Configuration of Cylinder Lock Device

Figure 1B:
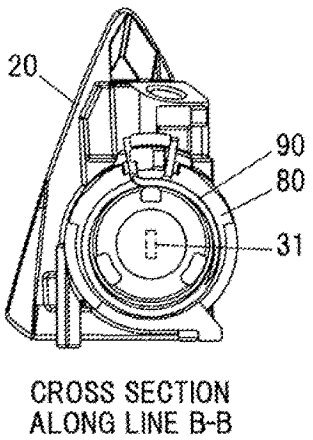
FIG. 1B is a cross sectional view taken on line B-B in FIG. 1A.
Figure 1A:
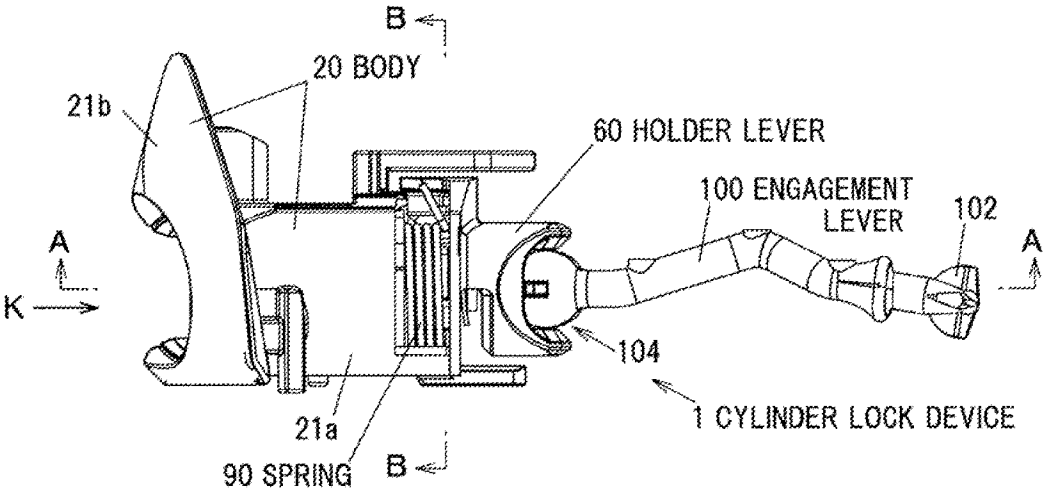
FIG. 1A is a side view showing a cylinder lock device in an embodiment of the invention.
Figure 1C:
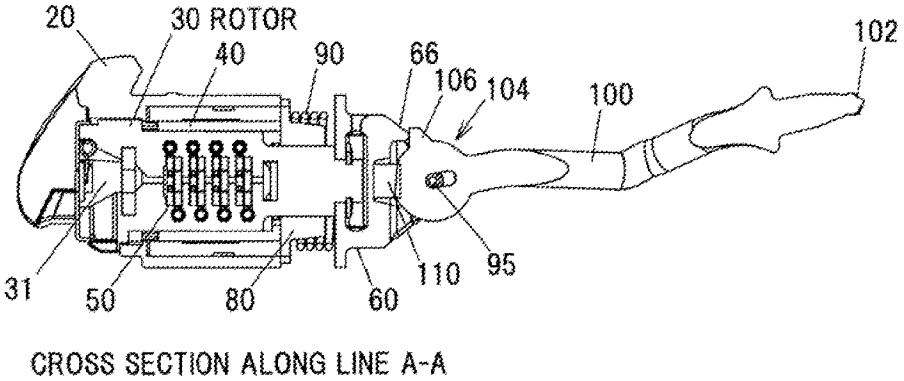
FIG. 1C is a cross sectional view taken on line A-A in FIG. 1A.

FIG. 1A is a side view showing a cylinder lock device in the embodiment of the invention, FIG. 1B is a cross sectional view taken on line B-B in FIG. 1A and FIG. 1C is a cross sectional view taken on line A-A in FIG. A.

As shown in FIGS. 1A to 1C, a cylinder lock device 1 has a body 20, a rotor 30 rotatably arranged inside the body 20, a holder lever 60 rotationally driven along with rotation of the rotor 30, and an engagement lever 100 which is link-connected to the holder lever 60 so as to be angularly adjustable and rotationally driven along with the rotation of the rotor 30. In the cylinder lock device 1, a retention mechanism 120 to hold the engagement lever 100 into a predetermined direction relative to the body 20 is configured to force a protrusion 106 provided on the engagement lever 100 to contact the holder lever 60 by an elastic force thereof.

As shown in FIGS. 1A and 1C, the cylinder lock device 1 is composed of the rotor 30, a first sleeve 40 and tumblers 50, which are housed in the body 20, and also the holder lever 60, a second sleeve 80 and a spring 90, etc.

The body 20 is composed of a cylindrical portion 21*a* and a front portion 21*b*, etc. The cylindrical portion 21*a* houses the rotor 30 and the first sleeve 40, etc. The front portion 21*b* is a portion to be exposed to a surface a vehicle door, etc., when installing the device. The body 20 is attached and fixed in a state that the cylindrical portion 21*a* is inserted into an insertion hole of a vehicle door panel, etc., and the front portion 21*b* is exposed to the surface of the door panel.

The rotor 30 is in a substantially cylindrical shape and is rotatably housed in the cylindrical portion 21*a* of the body 20. A key insertion hole 31 is formed on the rotor 30 so as to extend in an axial direction. The rotor 30 is rotated with respect to the body 20 by rotationally operating a key inserted into the key insertion hole 31.

The first sleeve 40 is in a substantially cylindrical shape and is rotatably arranged on the outer periphery of the rotor 30. Engaging grooves engageable with the tumblers 50 are formed on the first sleeve 40 and the rotor 30 rotates integrally with the first sleeve 40 when the tumblers 50 pressed radially outward are engaged with the engaging grooves. A hole matching a correct key is formed on each tumbler 50. Each tumbler 50 moves in a radial direction along a grove shape of the key inserted into the rotor 30. When the correct key is inserted, all tumblers 50 are separated and disengaged from the first sleeve 40, thereby allowing the rotor 30 and the first sleeve 40 to be rotated independently.

The second sleeve 80 is in a substantially circular-disc shape and has a receiving hole which is formed in the center to receive an end of the rotor 30 and allows the second sleeve 80 to rotate along with rotation of the rotor 30 by the correct key. A cylindrical portion is formed on the second sleeve 80 so as to extend toward the holder lever 60 and plural coupling portions are formed to protrude from an end of the cylindrical portion. The coupling portions are inserted into insertion holes formed on the holder lever 60. This allows the second sleeve 80 to be axially movable with respect to the holder lever 60 and also allows the rotation of the rotor 30 to be transmitted to the holder lever 60.

The spring 90 is a torsion coil spring as a pressing member and is composed of a coiled portion as a compression spring and end portions each protruding in a radial direction. Thus, the spring 90 functions as a compression spring for pressing the second sleeve 80 toward the rotor 30 and also as a torsion spring for generating a pressing force in a circumferential direction which is a restoring force against rotating operation of the rotor 30 by a key to return to the neutral position.

The holder lever 60 rotates along with the rotation of the rotor 30 and the second sleeve 80 by the correct key. The holder lever 60 has a coupling portion 62 at an end which is link-connected to a coupling portion 104 of the engagement lever 100 (described later). Thus, rotation of the holder lever 60 is transmitted to the engagement lever 100 and a connecting portion 102 formed at an end of the engagement lever 100 is rotationally driven. The connecting portion 102 is connected to a door lock mechanism 210 arranged in a door panel 200. The door lock mechanism 210 is driven by rotation of the connecting portion 102 along with rotation of a key (the rotor 30) and the door is thereby locked or unlocked.

The engagement lever 100 is composed of a shaft 101, the connecting portion 102 formed at an end portion of the shaft 101 for connection to the door lock mechanism 210, and the coupling portion 104 formed at another end portion of the shaft 101 for link-connection to the holder lever 60. Rotation of the engagement lever 100 along with the rotation of the rotor 30, the second sleeve 80 and the holder lever 60 acts on the door lock mechanism 210 which thereby locks or unlocks a vehicle door. In addition, an angle of the engagement lever 100 with respect to the holder lever 60, i.e., with respect to the body 20, is adjustable and it is thereby easy to attach the engagement lever 100 to the door lock mechanism 210 provided in the door panel.

Figure 2:
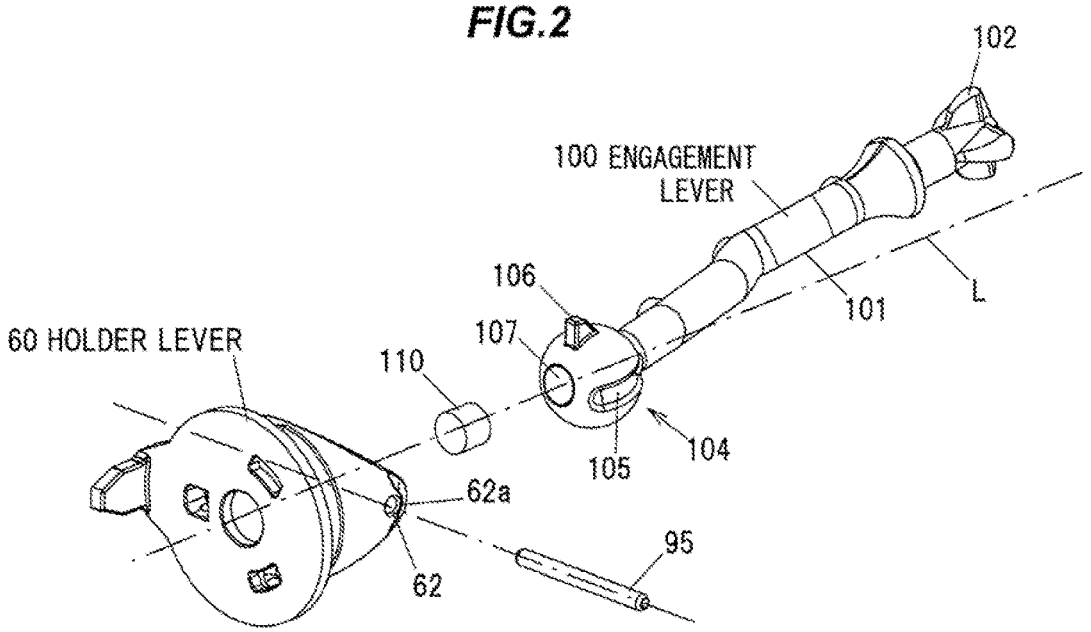
FIG. 2 is a perspective view showing a retention mechanism and an engagement lever of the cylinder lock device in the embodiment of the invention.
Figure 3:
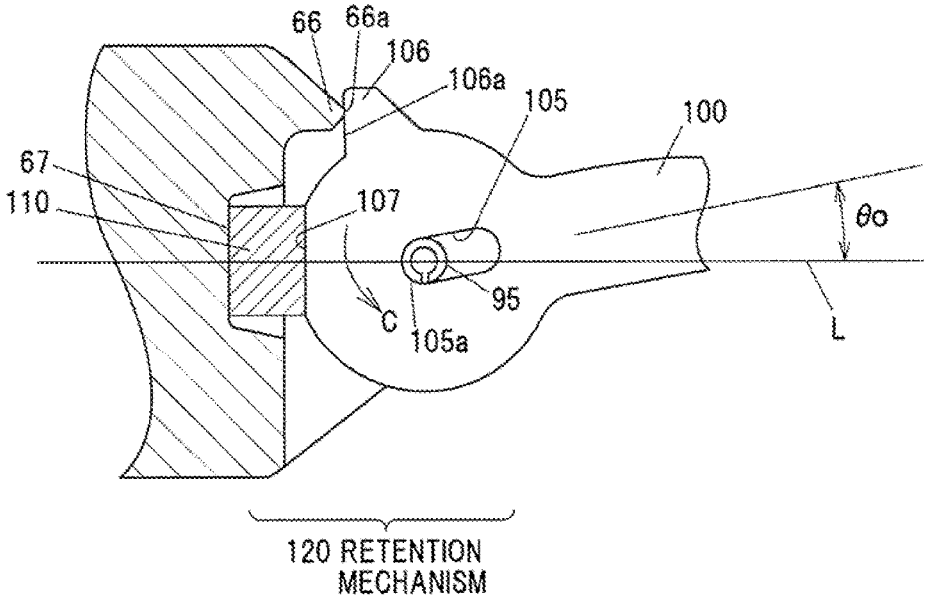
FIG. 3 is a cross sectional view showing the retention mechanism.

FIG. 2 is a perspective view showing a retention mechanism and an engagement lever of the cylinder lock device in the embodiment of the invention and FIG. 3 is a cross sectional view showing the retention mechanism.

The retention mechanism 120 is to hold the engagement lever 100 into the predetermined direction relative to the body 20 and is composed of the coupling portion 62 of the holder lever 60 and the coupling portion 104 of the engagement lever 100. The coupling portion 62 is formed on the holder lever 60 at an end portion on the engagement lever 100 side. As shown in FIG. 2, a hole 62*a* is formed on the coupling portion 62. A pin 95 is inserted through the hole 62*a* to link-connect the coupling portion 62 to the coupling portion 104 of the engagement lever 100, as previously described.

The holder lever 60 also has a receiving portion 66 with which the protrusion 106 of the engagement lever 100 comes into contact, as shown in FIG. 3. In addition, a recessed portion 67 is formed in the center of the holder lever 60 to house a resilient member 110.

The resilient member 110 can be formed of various types of materials as long as an elastic force is generated, and it is possible to use a cushion material or a spring material, etc. The material used in the present embodiment is a cushion material, e.g., a rubber material (urethane, silicon, chloroprene, etc.) or a sponge material, etc.

Meanwhile, a long hole 105 for inserting the pin 95 is formed on the coupling portion 104 of the engagement lever 100, as shown in FIG. 3. The protrusion 106 is formed at an end of the coupling portion 104. In addition, a pressing surface 107 to be in contact with the resilient member 110 is formed on the coupling portion 104 at an end portion facing the recessed portion 67 of the holder lever 60. The pressing surface 107 is formed a surface inclined relative to a predetermined direction, as described later.

The pin 95 is inserted into the hole 62*a* of the coupling portion 62 as well as into the long hole 105 of the coupling portion 104, thereby link-connecting the holder lever 60 to the engagement lever 100. This configuration provides the retention mechanism 120 which allows the engagement lever 100 to be angularly adjusted relative to the holder lever 60, i.e., the body 20, to rotate in conjunction with the holder lever 60, and to be held into the predetermined direction.

As shown in FIG. 3, in the retention mechanism 120, the pressing surface 107 of the engagement lever 100 is formed a surface inclined relative to a predetermined direction as the direction of a reference line L which is a rotation center of the body 20, the rotor 30 and the holder lever 60, etc. Thus, a turning force in a C-direction is generated about the pin 95 by an elastic force from the resilient member 110 and a contact surface 106*a* of the protrusion 106 reliably comes into contact with an end portion 66*a* of the receiving portion 66. In other words, the retention mechanism 120 to hold the engagement lever 100 into the predetermined direction relative to the body 20 is configured to force the protrusion 106 provided on the engagement lever 100 to contact the holder lever 60 by the elastic force. It is thereby possible to hold the engagement lever 100 into a predetermined direction $\theta_0$ as the direction of the reference line L.

Mounting of Cylinder Lock Device on Door Panel

Figure 4A:
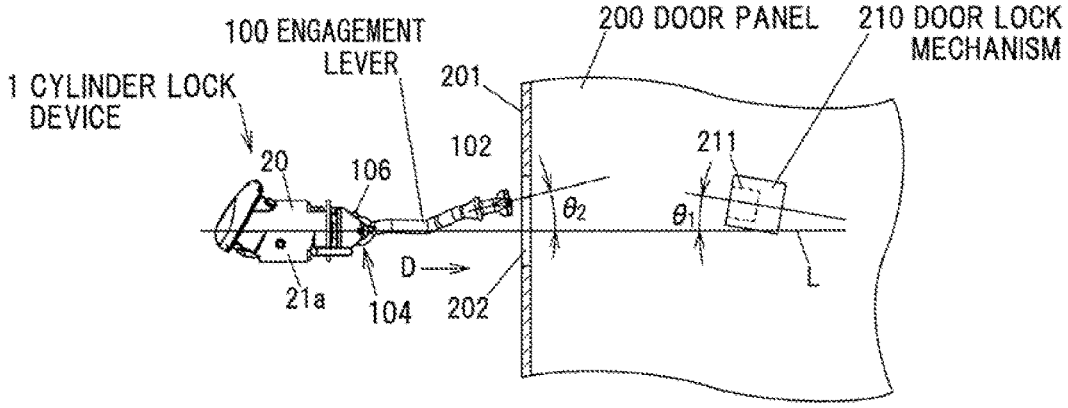
FIGS. 4A to 4C are cross sectional views of a door panel of a vehicle when viewed horizontally, sequentially showing steps of mounting the cylinder lock device on the door panel, wherein the cylinder lock device is not illustrated with cross sections.
Figure 4B:
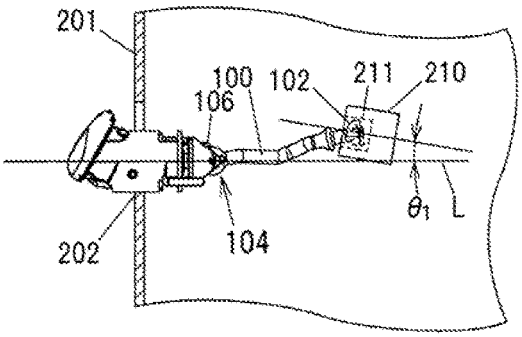
Figure 4C:
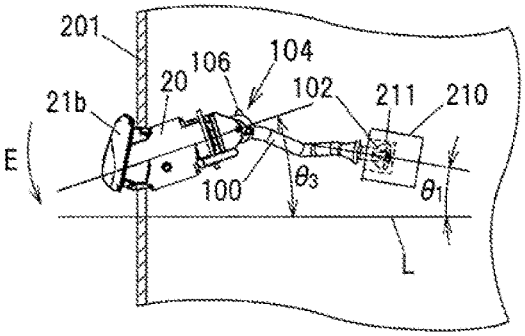

FIGS. 4A to 4C are cross sectional views of a door panel of a vehicle when viewed horizontally, sequentially showing steps of mounting the cylinder lock device on the door panel. Note that, the illustration of the cylinder lock device in FIGS. 4A to 4C is not a cross section.

Inside the door panel 200, the door lock mechanism 210 is arranged at a predetermined position and a predetermined angle, as shown in FIG. 4A. The door lock mechanism 210 is arranged in the predetermined direction $\theta_1$ relative to the direction of the reference line L. Meanwhile, a mounting hole 202 for mounting the cylinder lock device 1 is formed on a panel surface 201 of the door panel 200.

As shown in FIG. 3, the engagement lever 100 of the cylinder lock device 1 is held in the predetermined direction $\theta_0$ relative to the direction of the reference line L. In this state, the connecting portion 102 is inclined in a direction $\theta_2$ relative to the direction of the reference line L, as shown in FIG. 4A.

Next, as shown in FIG. 4B, the cylindrical portion 21*a* of the body 20 of the cylinder lock device 1 is inserted into the door panel 200 through the mounting hole 202 on the panel surface 201 in a D-direction along the reference line L, i.e., in a horizontal direction, while maintaining the angles $\theta_0$ and the $\theta_2$ shown in FIGS. 3 and 4A. A guide rail, etc., may be provided inside the door panel 200 so that the engagement lever 100 does not come out of the track during insertion.

The insertion along the reference line L is completed in a state that the connecting portion 102 located at an end of the engagement lever 100 is close to or in contact with a connecting portion 211 of the door lock mechanism 210, as shown in FIG. 4B.

During the insertion along the reference line L, due to the function of the retention mechanism 120, the engagement lever 100 is held at the predetermined direction $\theta_0$ relative to the direction of the reference line L and the connecting portion 102 located at the end of the engagement lever 100 is held in the predetermined direction $\theta_2$ relative to the direction of the reference line L.

Next, as shown in FIG. 4C, the body 20 is rotated in an E-direction in a state that the connecting portion 102 of the engagement lever 100 is in contact with the connecting portion 211 of the door lock mechanism 210. This rotation causes a bend at the retention mechanism 120 and the contact between the protrusion 106 and the receiving portion 66 is thus released. At this time, the front portion 21*b* of the body 20 is fixed at a predetermined angle with respect to the panel surface 201. In this state, the body 20 is inclined at an angle $\theta_3$ relative to the reference line L, while the connecting portion 102 of the engagement lever 100 coincides with the direction $\theta_1$ of the door lock mechanism 210.

As described above, while presence of the resilient member 110 allows the direction of the engagement lever 100 to be held into the predetermined direction during the insertion, deformation of the resilient member 110 allows the retention mechanism 120 to be bent when the body 20 is rotationally operated. The engagement lever 100 is inserted in the D-direction while being held into the predetermined direction relative to the body 20 and the body 20 is then rotated in the E-direction while the connecting portion 102 of the engagement lever 100 is contacted with the connecting portion 211 of the door lock mechanism 210, thereby completing mounting of the cylinder lock device on the door panel.

Effects of the Embodiment of the Invention

In the embodiment of the invention, the following effects are obtained.

(1) Since the retention mechanism 120 to hold the engagement lever 100 into the predetermined direction relative to the body 20 is provided, it is possible to prevent the engagement lever 100 from moving downward under its own weight during mounting. Therefore, the device is always in a state of being mountable on a vehicle.

(2) Since the engagement lever 100 is held into the predetermined direction relative to the body 20 during mounting work, it is easy to mount the device and it is thereby possible to reduce working hours.

(3) In the retention mechanism 120, a cushion material used as the resilient member 110 is expected to exert an effect of preventing the link-connection using the pin 95 from rattling.

Although the cylinder lock device 1 for locking/unlocking a vehicle door has been described as an example of the embodiment, the cylinder lock device 1 may be configured to lock/unlock, e.g., house doors or drawers, etc.

Although the typical embodiment and illustrated examples of the invention have been described, the invention according to claims is not to be limited thereto. It should be therefore noted that all combinations of the features described in the embodiment and illustrated examples are not necessary to solve the problem of the invention.

What is claimed is:

1. A cylinder lock device, comprising:

a body;

a rotor rotatably arranged inside the body;

a holder lever rotationally driven according to a rotation of the rotor;

an engagement lever that is link-connected to the holder lever so as to be angularly adjustable and rotationally driven according to a rotation of the rotor; and a retention mechanism to hold the engagement lever into a predetermined direction relative to the body, wherein the retention mechanism is configured to force a protrusion of the engagement lever into forceful contact with the holder lever by an elastic force during mounting of the cylinder lock device so as to hold the engagement lever in the predetermined direction, and to release the forceful contact between the protrusion and the holder lever by rotating the body after completing the mounting.

2. The cylinder lock device according to claim 1, wherein the retention mechanism comprises a resilient member to generate the elastic force.

3. The cylinder lock device according to claim 2, wherein the resilient member comprises a rubber material.

4. The cylinder lock device according to claim 1, wherein the engagement lever comprises a pressing surface pressed by the resilient member, and wherein the pressing surface is inclined relative to the predetermined direction.

5. The cylinder lock device according to claim 1, wherein the predetermined direction intersects an axis of rotation of the rotor at an angle.

* * * * *